US006553592B2

(12) United States Patent
Yang et al.

(10) Patent No.: US 6,553,592 B2
(45) Date of Patent: Apr. 29, 2003

(54) NAIL CUTTER EQUIPPED WITH SUPPLEMENTARY FUNCTION

(76) Inventors: Moonchill Yang, #101, Segi-6$^{th}$ APT, 1066-2 Nohyung-dong, 690-180, Cheju-city, Cheju-do (KR); Moonsuk Yang, #595, Sangchang-ri, Anduck-myun, 699-821, Namjeju-gun, Cheju-do (KR)

( * ) Notice: Subject to any disclaimer, the term of this patent is extended or adjusted under 35 U.S.C. 154(b) by 0 days.

(21) Appl. No.: 09/926,735

(22) PCT Filed: Jan. 18, 2001

(86) PCT No.: PCT/KR01/00086

§ 371 (c)(1),
(2), (4) Date: Jul. 16, 2002

(87) PCT Pub. No.: WO01/52692

PCT Pub. Date: Jul. 26, 2001

(65) Prior Publication Data

US 2002/0178585 A1 Dec. 5, 2002

(30) Foreign Application Priority Data

Jan. 18, 2000 (KR) ..... 2000/1316

(51) Int. Cl.[7] ..... A45D 29/02

(52) U.S. Cl. ..... 7/162; 30/28; 362/119; 362/577

(58) Field of Search ..... 362/119, 120, 362/577; 30/28, 123; 7/118–120, 162; 132/75.5

(56) References Cited

U.S. PATENT DOCUMENTS 3,943,948 A * 3/1976 Sartore ..... 30/28 X
5,666,728 A * 9/1997 Silva ..... 30/28
6,027,224 A * 2/2000 Schnell ..... 362/119
6,179,433 B1 * 1/2001 Shiao ..... 362/120 X
6,220,251 B1 * 4/2001 Jeong et al. ..... 30/28 X
6,273,582 B1 * 8/2001 Taggart et al. ..... 362/119

FOREIGN PATENT DOCUMENTS

| | | |
|---|---|---|
| JP | 50143773 | 11/1975 |
| JP | 5257869 | 4/1977 |
| JP | 5271872 | 5/1977 |
| JP | 5427876 | 2/1979 |
| JP | 5769602 | 4/1982 |

OTHER PUBLICATIONS

PCT International Search Report for International Application No. PCT/KR01/00086, dated Jun. 7, 2001.

* cited by examiner

*Primary Examiner*—Douglas D. Watts

(57) ABSTRACT

The object of this invention is to provide a nail clipper with supplementary functions. In the nail clipper, a folding plate (34) is rotatably mounted to the rear joint of the clipper's body such that it is rotatable between its folded position and its exposed position. A housing (30) is provided at the free end of the folding plate (34), with a flexible extension (39) extending from the housing (30) and designed to be changeable in its length and bent to be curved as desired. A light emitting device (31), used for illuminating a target place while clipping the nails, is set at the tip of the extension (39). The nail clipper also has a melody chip (42) for producing a melody, in addition to having a battery (40). In another embodiment, the light emitting device (31), melody chip (42) and battery (40) are held on a casing (50) covering the rear portion of the clipper's body.

6 Claims, 5 Drawing Sheets

NAIL CUTTER EQUIPPED WITH SUPPLEMENTARY FUNCTION

TECHNICAL FIELD

The present invention relates, in general, to nail clippers used for clipping or trimming the fingernails or toenails and, more particularly, to a nail clipper with supplementary functions of illuminating the jaws of the clipper and producing a melody while clipping the nails.

BACKGROUND ART

As well known to those skilled in the art, a nail clipper is a device for clipping or trimming the fingernails or toenails, and typically comprises upper and lower longitudinal plates jointed together at their rear ends into an elastic single body through a riveting process or a welding process, with a sharpened jaw formed at the front end of each plate. A lever is mounted to a shaft at the front part of the top surface of the upper plate While clipping the nails, a user repeatedly levers the elastic upper plate down relative to the lower plate to clip or trim the nails by the jaws.

FIG. 1 is an exploded perspective view of a conventional nail clipper. As shown in the drawing, the upper and lower plates 11 and 12 are jointed together at their rear ends through a riveting process or a welding process into an elastic single body, with a sharpened jaw 17 or 18 formed at the front edge of each plate 11 or 12. A folding nail file 20 is rotatably mounted to the rear joint of the two plates 11 and 12 such that the file 20 is rotatable between a folded position inside the gap between the two plates 11 and 12 and an exposed position outside the two plates 11 and 12. A shaft hole 16 is formed at each of the front parts of the two plates 11 and 12, while a shaft 14 having a base upwardly penetrates the holes 16 of the two plates 11 and 12 such that the base of the shaft 14 is stopped on the lower surface of the lower plate 12. The shaft 14 has a hook 19 on its sidewall.

A lever 13, having a hinge rib 15 at its front end, is movably caught by the hook 19 of the shaft 14 at the hinge rib 15. The lever 13 is normally biased upward by the elastic upper plate 11, and so it is possible to maintain the movable engagement of the hinge rib 15 of the lever 13 with the hook 19 of the shaft 14 without allowing an undesired removal of the lever 13 from the hook 19. The folding nail file 20 is rotatably mounted to the rear joint of the upper and lower plates 11 and 12 such that the file 20 is rotatable between its folded position inside the gap between the two plates 11 and 12 and its exposed position outside the two plates 11 and 12.

In order to trim the nails, a user repeatedly levers the elastic upper plate 11 down relative to the lower plate 12 by the lever 13 with a target nail placed between the two jaws 17 and 18, thus trimming the nail.

However, the conventional nail clipper is problematic in that it is somewhat difficult for users to clearly observe the jaws of the nail clipper while clipping the nails in a dark area, and so the clipper may unexpectedly injure the fingers or toes. In addition, most children do not like a nail clipping action since the conventional nail clippers do not excite children's interest while clipping the nails, and so some parents unnecessarily undergo difficulty while clipping or trimming the nails of their children.

DISCLOSURE OF THE INVENTION

Accordingly, the present invention has been made keeping in mind the above problems occurring in the prior art, and an object of the present invention is to provide a nail clipper provided with supplementary functions of illuminating the jaws and producing a melody during a nail clipping action.

Another object of the present invention is to provide a nail clipper, of which the body is partially covered with a casing having the supplementary functions of illuminating the jaws and/or producing a melody during a nail clipping action.

In order to accomplish the above object, the present invention provides a nail clipper comprising an upper plate and a lower plate jointed together at their rear ends into a single body, with a lever used for levering the upper plate down relative to the lower plate to clip the nails, further comprising: a folding plate rotatably mounted to the rear joint of the upper and lower plates such that the folding plate is rotatable between its folded position inside a gap between the upper and lower plates and its exposed position outside the upper and lower plates; a housing provided at the free end of the folding plate such that the housing is positioned between the upper and lower plates when the holding plate is fully rotated into the gap between the upper and lower plates; a flexible extension extending from the housing, and designed to be changeable in its length and bent to be curved as desired; and a light emitting device used for illuminating a target place, the light emitting device being electrically activated by a battery installed within the housing.

The nail clipper also has a melody chip activated by the electricity supplied from the battery to produce a melody.

Another embodiment of this invention provides a nail clipper comprising an upper plate and a lower plate jointed together at their rear ends into a single body, with a lever used for levering the upper plate down relative to the lower plate to clip the nails, further comprising: a cover partially covering the rear portion of the body of the nail clipper, the cover holding a battery, a melody chip, and a switch used for activating the melody chip using electricity supplied from the battery.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
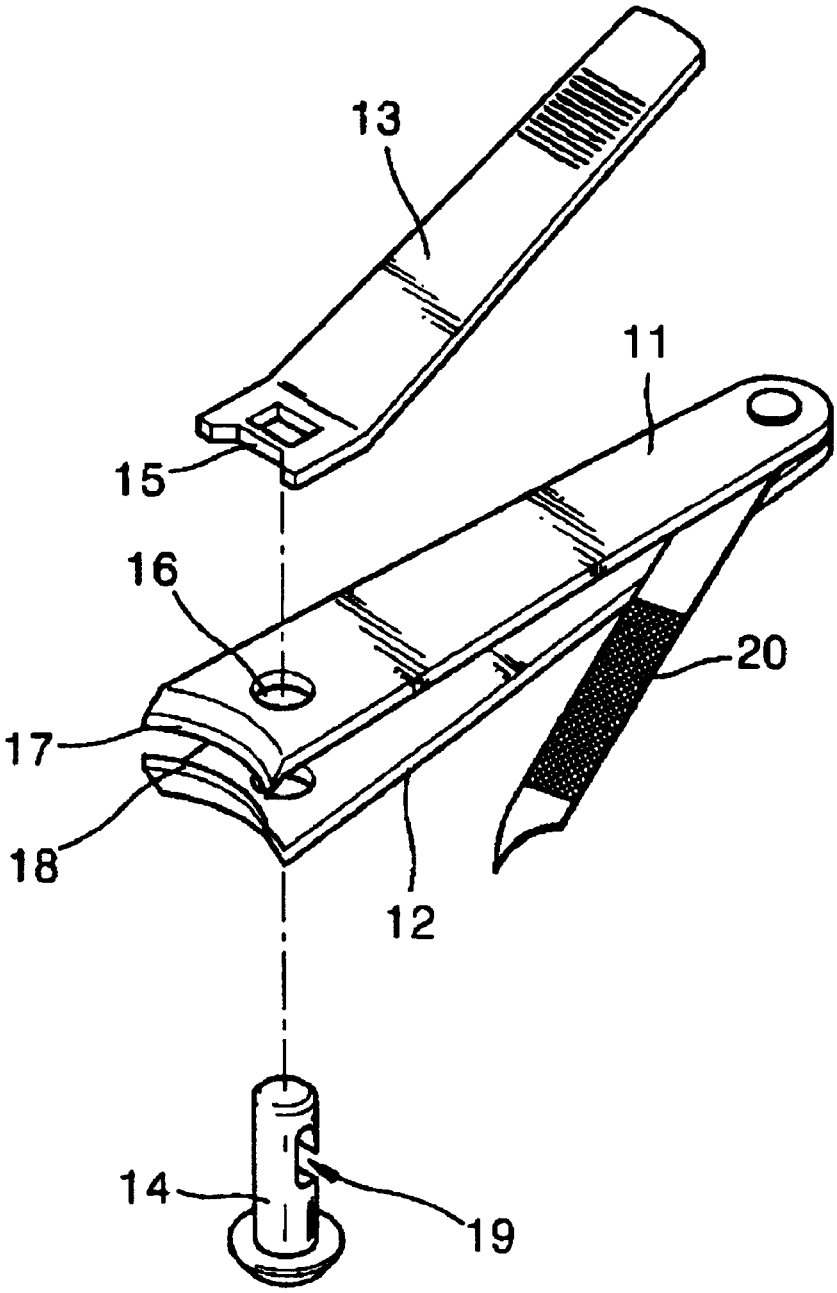
FIG. 1 is an exploded perspective view of a conventional nail clipper.

Reference now should be made to the drawings, in which the same reference numerals are used throughout the different drawings to designate the same or similar components.

Figure 2:
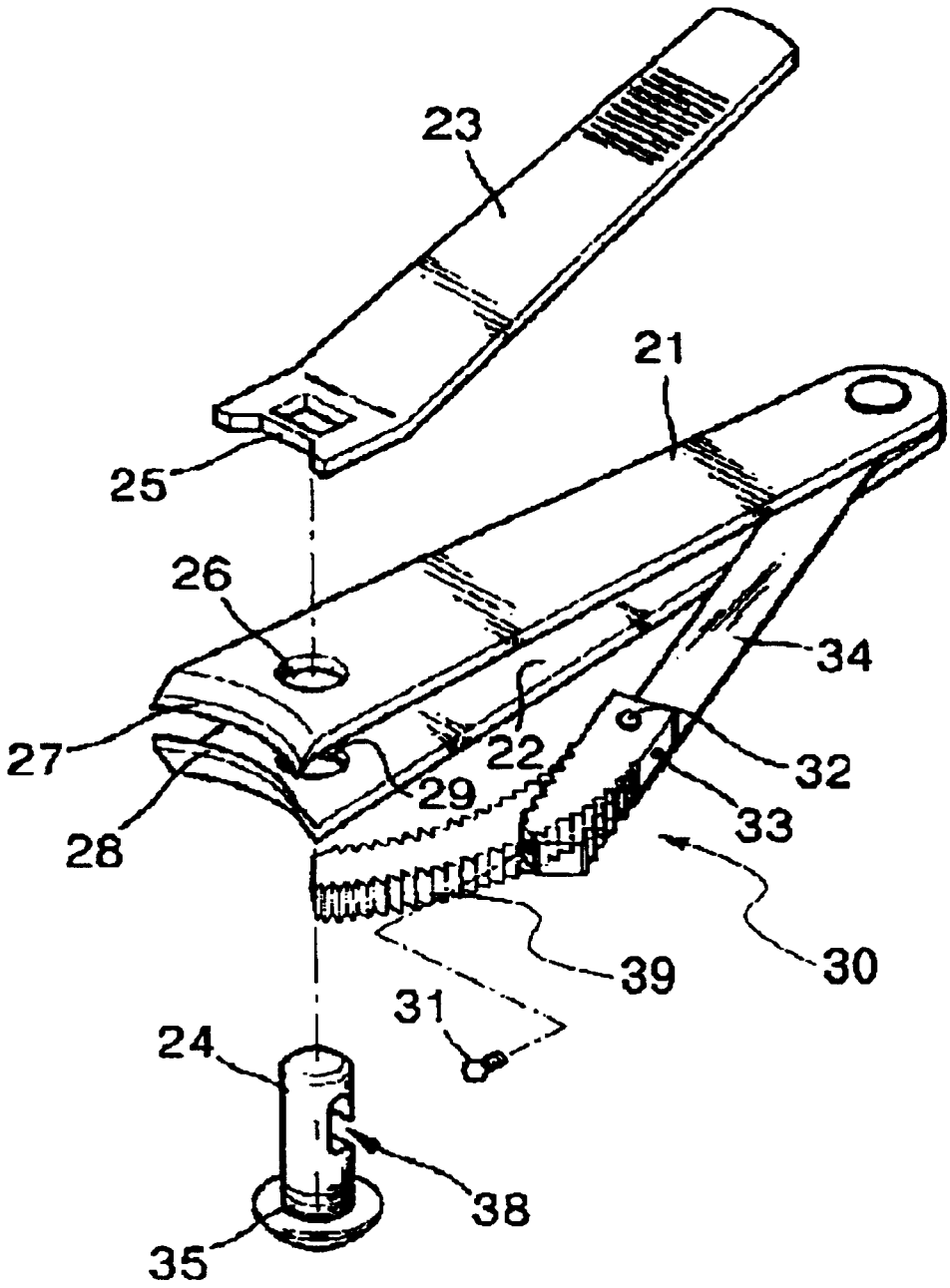
FIG. 2 is an exploded perspective view of a nail clipper with supplementary functions in accordance with the primary embodiment of the present invention.

FIG. 2 shows a nail clipper with supplementary functions in accordance with the primary embodiment of this invention. As shown in the drawing, the nail clipper according to the primary embodiment has a folding plate 34, which is rotatably mounted to the rear joint of the upper and lower plates 21 and 22 such that the plate 34 is rotatable between its folded position inside the gap between the two plates 21 and 22 and its exposed position outside the plates 21 and 22. A housing 30 is provided at the free end of the folding plate 34, and is positioned between the upper and lower plates 21 and 22 when the holding plate 34 is fully rotated into the gap between the two plates 21 and 22. A flexible extension 39, designed to be changeable in its length and bent to be curved as desired, extends from the housing 30. A light emitting device 31 is set at the front tip of the flexible extension 39, and is electrically activated by a battery installed within the housing 30, thus illuminating a target place.

In the nail clipper of this invention, the upper and lower plates 21 and 22 are jointed together at their rear ends through a riveting process or a welding process into an elastic single body, with a sharpened jaw 27 or 28 formed at the front edge of each plate 21 or 22. A shaft 24, having a base, upwardly penetrates the holes 26 and 29 formed at the front parts of the two plates 21 and 22 such that the base of the shaft 24 is stopped on the lower surface of the lower plate 22. A lever 23 is movably caught by the shaft 24 so as to allow a user to lever the upper plate 21 down relative to the lower plate 22. In the primary embodiment of FIG. 2, the shaft 24 has a hook 38 on its sidewall, while the lever 23 has a hinge rib 25 at its front end, and is movably caught by the hook 38 of the shaft 24 at the hinge rib 25, thus allowing a user to lever the upper plate 21 down relative to the lower plate 22. The lever 23 is normally biased upward by the elastic upper plate 21, and so it is possible to maintain the movable engagement of the hinge rib 25 of the lever 23 with the hook 38 of the shaft 24 without allowing an undesired removal of the lever 23 from the hook 38.

In another embodiment of this invention, the shaft has a lateral hole in place of the hook, while the lever is connected to the shaft by means of a pin, penetrating the lateral hole of the shaft, in place of the hinge rib 25.

In the primary embodiment of FIG. 2, the shaft hole 29 of the lower plate 22 is internally threaded, while the shaft 24 is externally threaded at its neck around the base to form an externally-threaded portion 35 engaging with the internally-threaded hole 29. Due to the screw-type engagement of the shaft 24 with the hole 29, it is possible to control the gap between the upper and lower plates 21 and 22 by rotating the shaft 24 relative to the hole 29 in either direction. In such a case, the rotating action of the shaft 24 is accomplished by horizontally rotating the lever 23.

Since the gap between the upper and lower plates 21 and 22 is controllable by the rotation of the shaft 24 relative to the hole 29, it is possible to control the gap between the two jaws 27 and 28. A user thus preferably controls the gap between the two jaws 27 and 28 as desired prior to trimming or clipping the nails. It is also possible for a user to control the engagement of the externally-threaded portion 35 of the shaft 24 with the internally-threaded hole 29 by horizontally rotating the lever 23.

In the nail clipper according to the primary embodiment of this invention, the folding plate 34 is rotatably mounted to the rear joint of the upper and lower plates 21 and 22 such that the plate 34 is rotatable between its folded position and its exposed position. The housing 30 is provided at the free end of the folding plate 34. This housing 30 has a thickness allowing the housing 30 to be closely positioned inside the gap between the upper and lower plates 21 and 22 when the holding plate 34 is fully rotated into the gap. The flexible extension 39 extends from the front end of the housing 30, with the light emitting device 31 set at the front tip of the flexible extension 39. In the preferred embodiment, the flexible extension 39 has a bellows structure, which is changeable in its length and bent to be curved as desired. Due to the bellows structure of the extension 39, it is possible for a user to lengthen the extension 39 and/or to bend the extension 39 toward the jaws 27 and 28 so as to change the lighting angle of the light emitting device 31. In the present invention, it is preferable to set the light emitting device 31 at the tip of the extension 39 such that it emits light to the jaws 27 and 28 when the folding plate 34 is positioned as shown in FIG. 2. In addition, it is possible to control the lighting angle of the light emitting device 31 as desired by bending the extension 39 and/or by controlling the length of the extension 39. In the present invention, a light bulb or a light emitting diode (LED) may be preferably used as the light emitting device 31. In order to activate the light emitting device 31, a battery is installed in the housing 30. In the drawing, the reference numeral 33 denotes a light switch, which controls the operation of the light emitting device 31.

In the nail clipper of this invention, a melody chip is preferably installed within the housing 30. In the present invention, it is possible to use a conventional melody chip, which is well known to those skilled in the art. The melody chip is electrically activated by the battery installed in the housing 30, and produces a predetermined melody while clipping the nails. In the drawing, the reference numeral 32 denotes a switch, which controls the operation of the melody chip.

From the above-mentioned description, it is well known to those skilled in that art that the basic construction of the nail clipper according to the primary embodiment of this invention remains the same as that of a conventional nail clipper having upper and lower plates with jaws at their front edges, with a lever mounted to the shaft at the front part of the upper surface of the upper plate. However, it should be understood that the construction of the nail clipper of this invention may be altered without affecting the functioning of this invention. Thus, the supplementary functions of illuminating the jaws and producing a melody may be provided on a casing of another type of nail clipper as will be described herein below.

Figure 3:
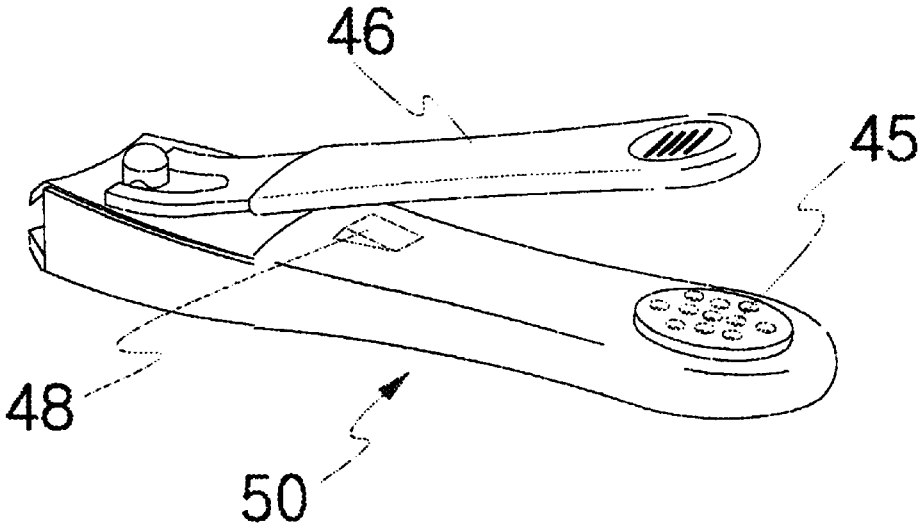
FIG. 3 is a perspective view of a nail clipper with supplementary functions in accordance with the second embodiment of the present invention.
Figure 4:
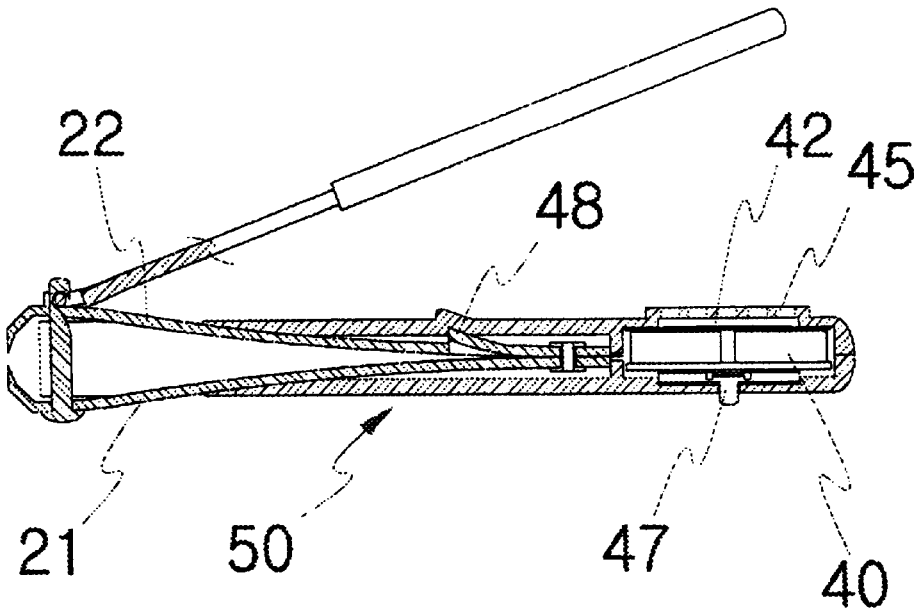
FIG. 4 is a side sectional view of the nail clipper of FIG. 3.

FIGS. 3 and 4 show a nail clipper with supplementary functions in accordance with the second embodiment of this invention. As shown in the drawings, the nail clipper of this embodiment comprises upper and lower plates jointed together at their rear ends into a single body, which is partially covered with a casing 50 used as a nail piece collecting means. A battery 40 and a melody chip 42 are set within the casing 50, with a switch 47 provided on the casing 50.

That is, the casing 50 has both the battery 40 and the melody chip 42 within the rear portion of its interior, while the switch 47, used for controlling the operation of the melody chip 42, is set on the lower surface of the rear part of the casing 50. It is thus possible for a user to activate the melody chip 42 to produce a predetermined melody as desired by operating the switch 42 while clipping the nails using the nail clipper.

Figure 5:
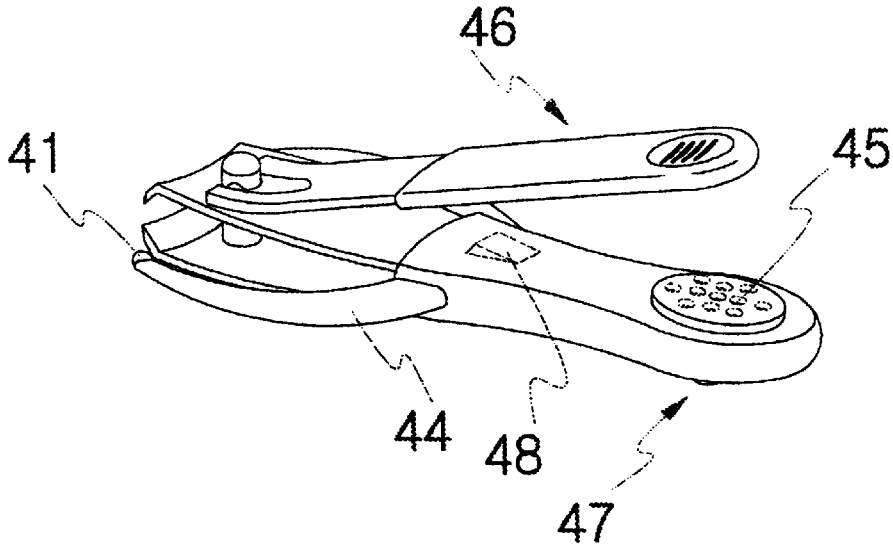
FIG. 5 is a perspective view of a nail clipper with supplementary functions in accordance with the third embodiment of the present invention.
Figure 6:
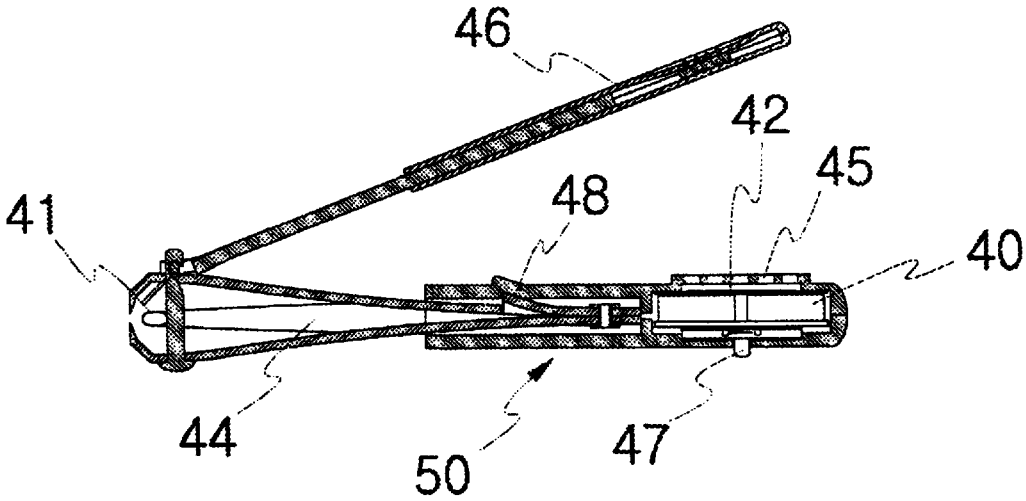
FIG. 6 is a side sectional view of the nail clipper of FIG. 5.
Figure 7:
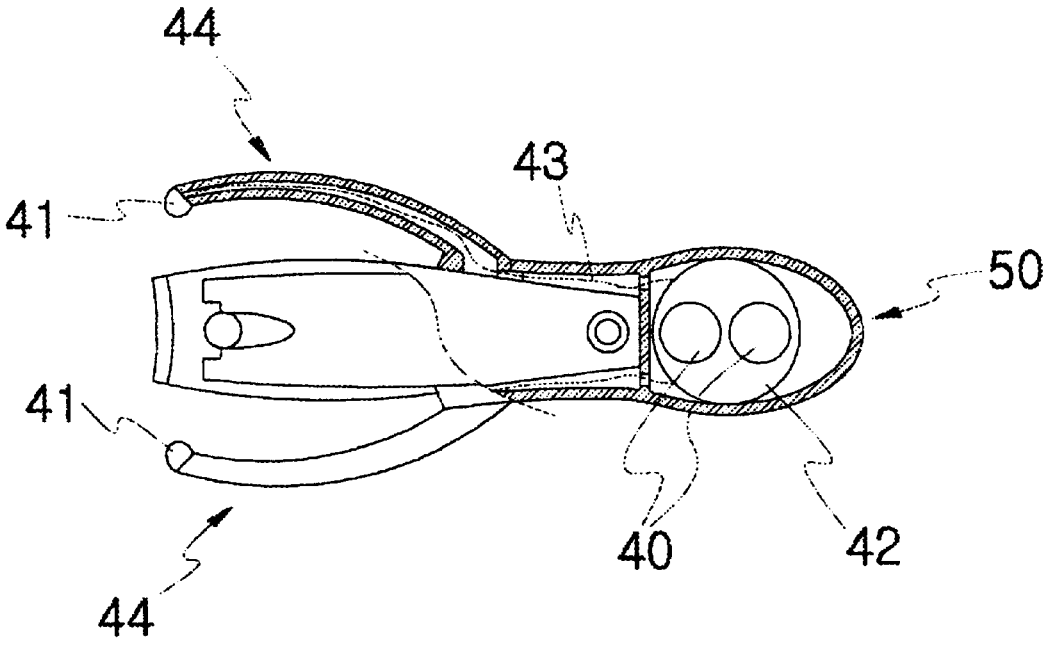
FIG. 7 is a plan sectional view of the nail clipper of FIG. 5.

FIGS. 5, 6 and 7 show a nail clipper with supplementary functions in accordance with the third embodiment of this invention. As shown in the drawings, the nail clipper of this embodiment comprises upper and lower plates jointed together at their rear ends into a single body, with a lever 46 mounted to the shaft at the front part of the upper surface of the upper plate. This nail clipper is also covered with a casing 50 at its rear portion. Both a battery 40 and a melody chip 42 are set within rear part of the interior of the casing 50, while a switch 47 is provided on the casing 50. Two flexible arms 44 extend from opposite front corners of the casing 50, and are each provided with a light emitting device 41 at its front tip. A conventional LED may be preferably used as the light emitting device 41, and is connected to the battery 40, thus being activated by electricity supplied from the battery 40.

As described above, the casing 50, covering the rear portion of the nail clipper of the third embodiment, has both the battery 40 and the melody chip 42 in the rear part of its interior, in addition to having the switch 47 on its lower surface. In addition, an LED used as the light emitting device 41 is set at the front tip of each flexible arm 44 of the casing 50, and is connected to the battery 40, thus illuminating both the jaws and a target nail while clipping or trimming the nails and allowing a user, particularly, an aged person having poor vision, to conveniently and safely clip or trim his nails, particularly in a dark area. The body of the nail clipper of the second or third embodiment has a projection 48 on the upper surface of its upper plate, while the casing 50 has a groove at a position corresponding to the projection 48. The engagement of the projection 48 with the groove retains the position of the casing 50 around the nail clipper's body without allowing an undesired removal of the casing 50 from the body.

The operational effect of the nail clipper having the casing 50 provided with the supplementary functions will be described herein below.

When the switch 47 provided on the casing 50 of the nail clipper is turned on, the two light emitting devices 41, such as an LED or a light bulb, are activated by the electricity supplied from the battery 40 to emit light to a target place. In such a case, the lighting angles of the two light emitting devices 41 are controllable by bending the two flexible arms 44 as desired. In addition, the melody chip 42 produces a predetermined melody at the same time of the light emitting action of the device 41, and so the melody comes out from the holes 45 formed on the upper surface of the casing 50. The light emitting action and melody producing action of the nail clipper of this invention excites children's interest while clipping the nails, thus allowing the children to enjoyably clip or trim their nails.

In the present invention, the switch 47 may be designed to have several modes: a power-on mode, a power-off mode, an illuminating mode, and a melody mode. This switch 47 having such modes allows a user to conveniently use the nail clipper.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides a nail clipper with supplementary functions of illuminating the jaws of the clipper and producing a melody while clipping the nails. The nail clipper illuminates both the jaws and a target nail while clipping or trimming the nails, thus allowing a user to conveniently and safely clip or trim his nails, particularly in a dark area. This nail clipper also produces a melody from its melody chip as desired. The light emitting action and melody producing action of the nail clipper excites children's interest while clipping the nails, thus allowing the children to enjoyably clip or trim their nails without being stressed by the nail clipping action. In this invention, the nail clipper may have a cover provided with such an illuminating function and a melody producing function, and so it is easy and simple to change the battery with a new one and to repair broken functional elements when necessary. Therefore, the present invention is preferably usable in the nail clipper producing industry.

What is claimed is:

1. A nail clipper comprising an upper plate and a lower plate jointed together at their rear ends into a single body, with a lever used for levering the upper plate down relative to the lower plate to clip the nails, further comprising:

a folding plate rotatably mounted to a rear joint of said upper and lower plates such that the folding plate is rotatable between its folded position inside a gap between the upper and lower plates and its exposed position outside said upper and lower plates, a housing provided at a free end of said folding plate such that the housing is positioned between the upper and lower plates when the holding plate is fully rotated into the gap between the upper and lower plates;

a flexible extension extending from said housing, and designed to be changeable in its length and bent to be curved as desired; and a light emitting device used for illuminating a target place, said light emitting device being electrically activated by a battery installed within said housing.

2. The nail clipper according to claim 1, further comprising a melody chip activated by electricity supplied from the battery to produce a melody.

3. A nail clipper comprising an upper plate and a lower plate jointed together at their rear ends into a single body, with a lever used for levering the upper plate down relative to the lower plate to clip the nails, further comprising:

a cover partially covering a rear portion of said body of the nail clipper, said cover holding a battery, a melody chip, and a switch used for activating the melody chip using electricity supplied from the battery.

4. The nail clipper according to claim 3, wherein said battery and melody chip are installed within a rear portion of an interior of said casing, while the switch is set on a surface of the casing, with a flexible arm extending from said casing and having a light emitting diode at its front tip, said light emitting diode being connected to the battery to be activated by electricity supplied from the battery.

5. The nail clipper according to claim 3, wherein said switch has a power-on mode, a power-off mode, an illuminating mode, and a melody mode.

6. The nail clipper according to claim 4, wherein said switch has a power-on mode, a power-off mode, an illuminating mode, and a melody mode.

* * * * *